US005893326A

United States Patent [19]

Wong

[11] Patent Number: 5,893,326

[45] Date of Patent: Apr. 13, 1999

[54] INK CUP AND METHOD FOR USING SAME

[75] Inventor: T. S. Wong, Hong Kong, The Hong Kong Special Administrative Region of the People's Republic of China

[73] Assignee: Jetta Company Limited, Hong Kong, The Hong Kong Special Administrative Region of the People's Republic of China

[21] Appl. No.: 08/906,762

[22] Filed: Aug. 5, 1997

[51] Int. Cl.[6] ..... B41F 31/04

[52] U.S. Cl. ..... 101/170; 101/163

[58] Field of Search ..... 101/163, 35, 41, 101/42, 43, 44, 150, 169, 167, 170

[56] References Cited

U.S. PATENT DOCUMENTS

| | | | |
|---|---|---|---|
| 3,831,517 | 8/1974 | Wagner | 101/208 |
| 3,896,723 | 7/1975 | Farrow et al. | 101/150 |
| 4,031,823 | 6/1977 | McGee | 101/120 |
| 5,003,872 | 4/1991 | Dalferth | 101/163 |
| 5,237,922 | 8/1993 | Ho | 101/163 |
| 5,392,706 | 2/1995 | Drew, II et al. | 101/170 |
| 5,476,040 | 12/1995 | Kleist | 101/163 |
| 5,537,921 | 7/1996 | Adner et al. | 101/35 |
| 5,577,442 | 11/1996 | Tanaka et al. | 101/163 |
| 5,664,496 | 9/1997 | Scheuhing et al. | 101/163 |

*Primary Examiner*—Edgar Burr
*Assistant Examiner*—Amanda B. Sandusky
*Attorney, Agent, or Firm*—Jeffer, Mangels, Butler & Marmaro LLP

[57] ABSTRACT

A device, apparatus and a method for containing a liquid within a liquid reservoir using a magnet and applying the liquid to a depression in a plate that is responsive to a magnet are disclosed. In particular there is provided a device for applying a liquid to a depression in a plate that is responsive to a magnet. The plate has a smooth flat surface. The device includes a reservoir for holding the liquid. The reservoir includes a wall which has an inner perimeter, an outer perimeter, a top surface and a bottom surface. The bottom surface of the wall is adapted to closely contact the smooth flat surface of the plate. The device also includes at least one ring magnet adjacent the outer perimeter of the wall of the reservoir.

21 Claims, 3 Drawing Sheets

INK CUP AND METHOD FOR USING SAME

FIELD OF THE INVENTION

The present invention relates to an ink cup for use in a printing apparatus.

BACKGROUND OF THE INVENTION

Apparatus for printing images on substrates, in particular, those which use a plate having depressions filled with ink whereupon the substrate to be printed on is contacted with the plate, are known in the art. Additionally, apparatus for printing images on substrates, in particular, those which use a pad which contacts a plate having depressions filled with ink whereupon the pad prints the image on the substrate, are known in the art. Such transfer printing and pad printing apparatus require a source of the ink which is applied to the plate to fill the depressions in the plate. The apparatus also requires a means for removing ink from the surface of the plate without removing the ink filling the depressions.

Ink cup or reservoir devices which provide both functions are known in the art. The ink cup contains the ink and is held in position over the plate. The ink cup has a generally open bottom which allows ink to contact the surface of the plate including any depressions thereon. The ink cup also has a bottom edge which, when the ink cup is moved along the surface of the plate, acts to remove ink from the surface of the plate while leaving the ink in the depressions in the plate.

The ink cup must be kept in close contact with the surface of the plate and the force around the bottom edge of the ink cup must be even or ink leakage and incomplete removal of ink from the surface of the plate can occur. Providing for contact of the ink cup edge with the surface of the plate by means such as springs (U.S. Pat. Nos. 5,577,442 and 5,476,040) and magnets (U.S. Pat. Nos. 5,392,706, 5,537,921 and 5,003,872) is known. However, even with the use of such means to provide close contact between the ink cup edge and the surface of the plate, leakage or incomplete removal of ink from the surface of the plate can occur.

Accordingly, it would be desirable to provide a transfer printing or pad printing apparatus and a method for transfer printing or pad printing using an ink reservoir device which is held in close contact with the surface of the plate to minimize the occurrence of leakage or incomplete removal of ink from the surface of the plate.

SUMMARY OF THE INVENTION

In accordance with one aspect of the present invention, there is provided a device for applying a liquid to a depression in a plate, the plate being responsive to a magnet and having a smooth flat surface. The device includes a reservoir for holding the liquid. The reservoir includes a wall which has an outer perimeter. The device includes at least one ring magnet adjacent the outer perimeter of the wall of the reservoir. In a preferred embodiment, the outer perimeter of the wall has a lip for supporting the magnet.

In accordance with another aspect of the present invention, there is provided a printing apparatus which includes the device as described above.

In accordance with a further aspect of the present invention, there is provided a method employing the inventive device.

Other features and advantages of the invention will become apparent from the following detailed description, taken in conjunction with the accompanying drawings which illustrate, by way of example, various features of preferred embodiments of the invention.

DESCRIPTION OF THE FIGURES

The detailed description of the invention will be made with reference to the accompanying drawings, where like numerals designate corresponding parts of the figures. The drawings are meant to be generally illustrative of various examples of the present invention, but are merely examples and are not meant to be limiting of the scope of the invention.

DETAILED DESCRIPTION OF THE INVENTION

Figure 1:
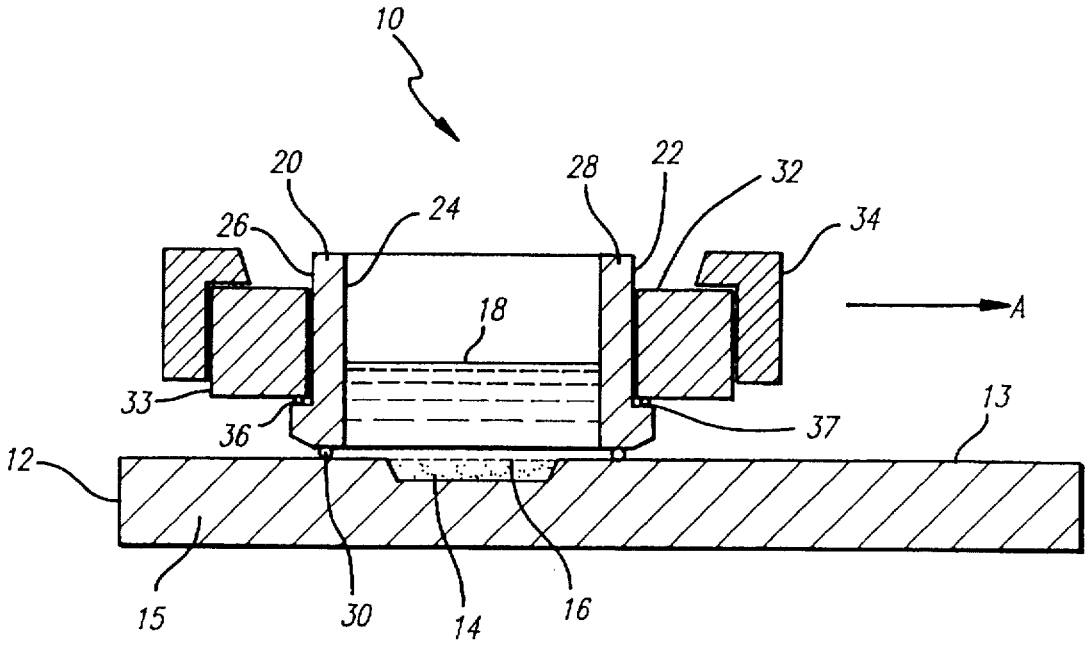
FIG. 1 is a top view illustrating one embodiment of a device of the invention for applying a liquid to a depression in a plate that is responsive to a magnet.
Figure 2:
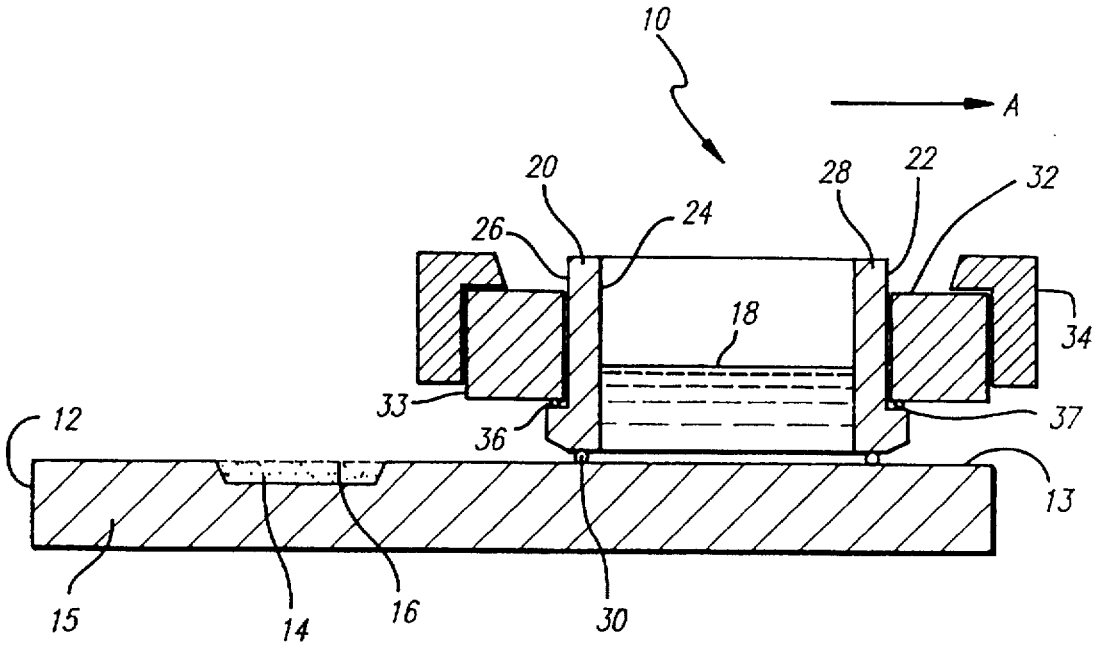
FIGS. 2 and 3 are cross-sectional views through line B—B of FIG. 1 illustrating the device of FIG. 1 in first and second positions, respectively, with the first position being situated over a depression in the plate and the second position being located across the surface of the plate and no longer situated over the depression in the plate.
Figure 3:
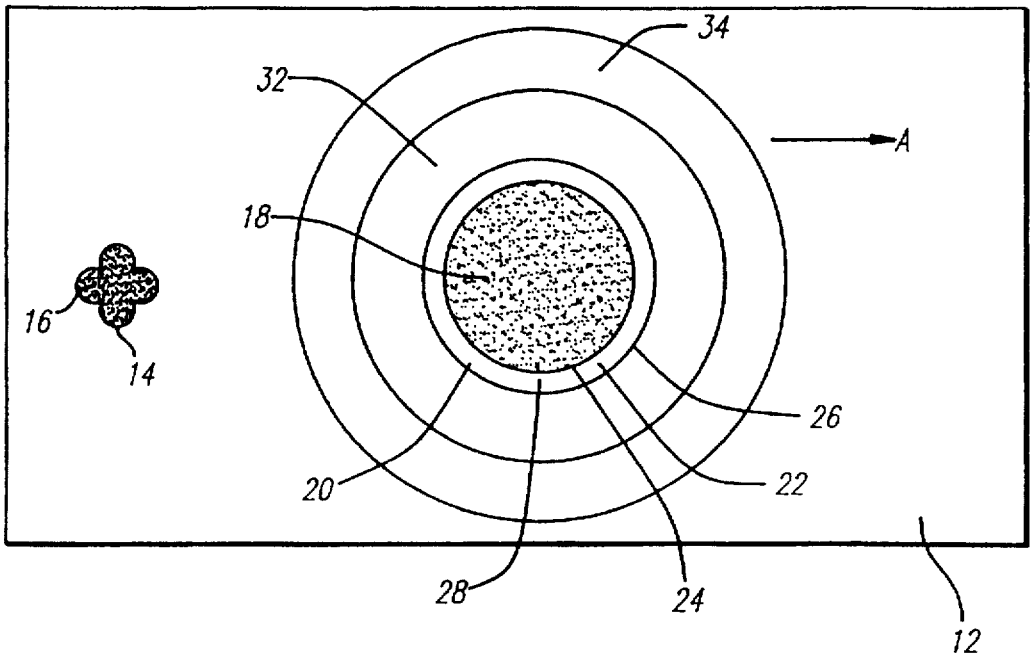

Turning now to the figures, FIGS. 1–3 depict a device 10 for applying a liquid to a depression 14 in a plate 12 that is responsive to a magnet. Device 10 is shown adjacent a smooth flat surface 13 of plate 12 and adjacent a depression 14 in plate 12. As shown in FIG. 1 depression 14 preferably is configured as a symbol such as an icon, a letter, a number and combinations thereof.

Device 10 includes a reservoir 20 which has a wall 22. In a particular embodiment reservoir 20 is an ink cup. Wall 22 has an inner perimeter 24, an outer perimeter 26, a top surface 28 and a bottom surface 30. In a preferred embodiment outer perimeter 26 of wall 22 includes a lip 36.

Magnet 32 is disposed adjacent outer perimeter 26 of wall 22. Collar 34 is disposed adjacent magnet 32. Collar 34 engages means 35 for providing a force to device 10 (not shown) which moves device 10 along surface 13 of plate 12 in the direction of arrow A.

Reservoir 20 contains a liquid 18. Preferably liquid 18 contains a pigment, more preferably a printing ink, very preferably a printing ink suitable for use with a transfer or pad inking process.

When device 10 is disposed over depression 14 in plate 12, liquid 18 is in communication with surface 13 of plate 12 and in communication with depression 14. Liquid 18 fills depression 14 with liquid 16. Magnet 32 engages plate 12 with a magnetic force directed down towards plate 12. Preferably, the magnetic force is evenly distributed around outer perimeter 26 of reservoir 20. The evenly distributed magnetic force provides a seal between bottom surface 30 of wall 22 and surface 13 of plate 12. This evenly distributed seal provided by magnet 32 prevents liquid 18 from leaking under bottom surface 30 and past wall 22 of reservoir 20. As device 10 moves along the surface 13 of plate 12, bottom surface 30 removes liquid 18 from surface 13 but passes over depression 14. Liquid 16 is thereby left in depression 14 but removed from surface 13 of plate 12. The magnetic force thus should be sufficient to engage the reservoir with the plate whereby ink can be deposited, and the reservoir moved to another position on the plate without leakage.

Plate 12 is responsive to a magnet. This magnetic responsiveness can be provided in a number of ways. For example, plate 12 can be entirely formed of a metal which is attracted to a magnet, such as iron or steel. In a particular embodiment plate 12 is preferably formed of a material having a hardness of about 55 to about 61 on the Rockwell Hardness scale C. Alternatively, an interior portion 15 of plate 12 can be formed of a material which itself is not attracted to a magnet, such as plastic, wood, non-magnetic metals, such as aluminum, but interior portion 15 can be covered at least on a top surface with a metal which is attracted to a magnet, such as iron or steel.

The opposite arrangement can also be used wherein a magnetic interior portion 15 is covered by a non-magnetic material. This embodiment is within the scope of the present invention so long as the non-magnetic material covering magnetic interior portion 15 allows for a magnetic interaction between magnet 32 and magnetic interior portion 15 so that there is provided an even seal about outer perimeter 26 of wall 22.

In a further embodiment, magnetic particles can be interspersed throughout a non-magnetic medium forming plate 12. In yet another embodiment, the plate can be a magnet or magnetic material can surround the plate depressions and the reservoir can be non-magnetic, but of a material that is attracted to the magnet(s) in the plate.

Combinations of any of the above can be used. It is also to be understood that the above embodiments are exemplary and other configurations of plate 12 which provide for a magnetic attraction between magnet 32 and plate 12 so that there is provided an even seal about outer perimeter 26 of wall 22 are within the scope of the present invention.

Plate 12 can contain a single depression 14 or a plurality of depressions 14, for example, a number of letters forming a word. If a number of depressions are present on plate 12, each depression is filled in a similar manner as described above.

Depression 14 is formed in plate 12 as is known in the art. Other than depression 14 in plate 12, plate 12 is preferably smooth and flat and most preferably mirror smooth. In a most preferred embodiment, plate 12 is formed of a nonabsorbent material.

Reservoir 20 can be formed of various materials suitable to contain a liquid without losing structural integrity. Preferably the material forming reservoir 20 can be moved across surface 13 of plate 12 without becoming worn down and requiring replacement sooner than about 1,000 cycles of use. More preferably, the material forming reservoir 20 can be moved across surface 13 of plate 12 without becoming worn down and requiring replacement sooner than about 20,000 cycles of use. Most preferably, the material forming reservoir 20 can be moved across surface 13 of plate 12 without becoming worn down and requiring replacement sooner than about 50,000 cycles of use. Alternatively, the material forming reservoir 20 should preferably be at least as hard as the material forming plate 12. In a particular embodiment, the material forming reservoir 20 has a hardness of about 150 to about 190 on the Brinell Hardness scale. More preferably the reservoir is formed of metal. Even more preferably the metal is at least as hard as the material forming plate 12. Most preferably the metal forming reservoir 20 is attracted to a magnet.

In a particular embodiment of the present invention, all or part of reservoir 20 can itself be a magnet.

Reservoir 20 is preferably cylindrically shaped and has a circular outer perimeter 26 and a circular inner perimeter 24. However, variations in the shape of reservoir 20 are within the scope of the present invention. For example, reservoir 20 can be triangularly shaped or rectangularly, including square, shaped. Other multiple-sided shapes such as pentagons, hexagons and the like can also be used. The shape of the reservoir can also vary between top surface 28 and bottom surface 30. For example, inner perimeter 24 and/or outer perimeter 26 can vary in cross-sectional size and/or shape between top surface 28 and bottom surface 30. Preferably, the shape of reservoir 20 allows for an even distribution of force by magnet 32 around outer perimeter 26.

Reservoir 20 is open at the bottom so that liquid 18 is in contact with surface 13 of plate 12. Reservoir 20 can be closed or open at the top. Means for refilling liquid 18 can be provided at the top of reservoir 20.

As stated above, in a preferred embodiment outer perimeter 26 of wall 22 includes a lip 36. Lip 36 can be disposed anywhere between top surface 28 and bottom surface 30 of wall 22. Lip 36 is preferably disposed closer to bottom surface 30 than to top surface 28 of wall 22. Lip 36 provides a preferably horizontal ledge 37 on which magnet 32 can be disposed.

A material can be disposed between magnet 32 and lip 36. For example, an adhesive can be disposed between magnet 32 and lip 36 to additionally securely mate magnet 32 to reservoir 20. Horizontal ledge 37 is preferably disposed on wall 22 so that when magnet 32 is disposed thereon magnet 32 is directly above at least a portion of bottom surface 30 of wall 22.

Bottom surface 30 of wall 22 is adapted to closely contact surface 13 of plate 12 so a seal can be provided between bottom surface 30 and surface 13 of plate 12, thereby containing liquid 18 in reservoir 20. The width of bottom surface 30 is preferably wide enough to withstand the downward force exerted by magnet 32 on bottom surface 30 without being deformed thereby. However, bottom surface 30 is preferably not so wide that the frictional force generated by movement of bottom surface 30 over surface 13 is greater than required for a good seal between bottom surface 30 and surface 13.

Preferably bottom surface 30 is flat and has a width of between about 0.02 mm and about 2 mm. However, bottom surface 30 can have a knife-edge thin width of about 0.005 mm. Bottom surface 30 in addition to being adapted to provide a seal between bottom surface 30 and surface 13 of plate 12 also functions as a doctoring blade. As bottom surface 30 is moved across surface 13 of plate 12 it removes any liquid 18 from surface 13 and liquid 18 so removed is contained within reservoir 20. Liquid 16 which resides in depression 14 is below the lowest level of bottom surface 30 and thereby remains in depression 14.

In a particular embodiment, bottom surface 30 can be a magnet.

Figure 5:
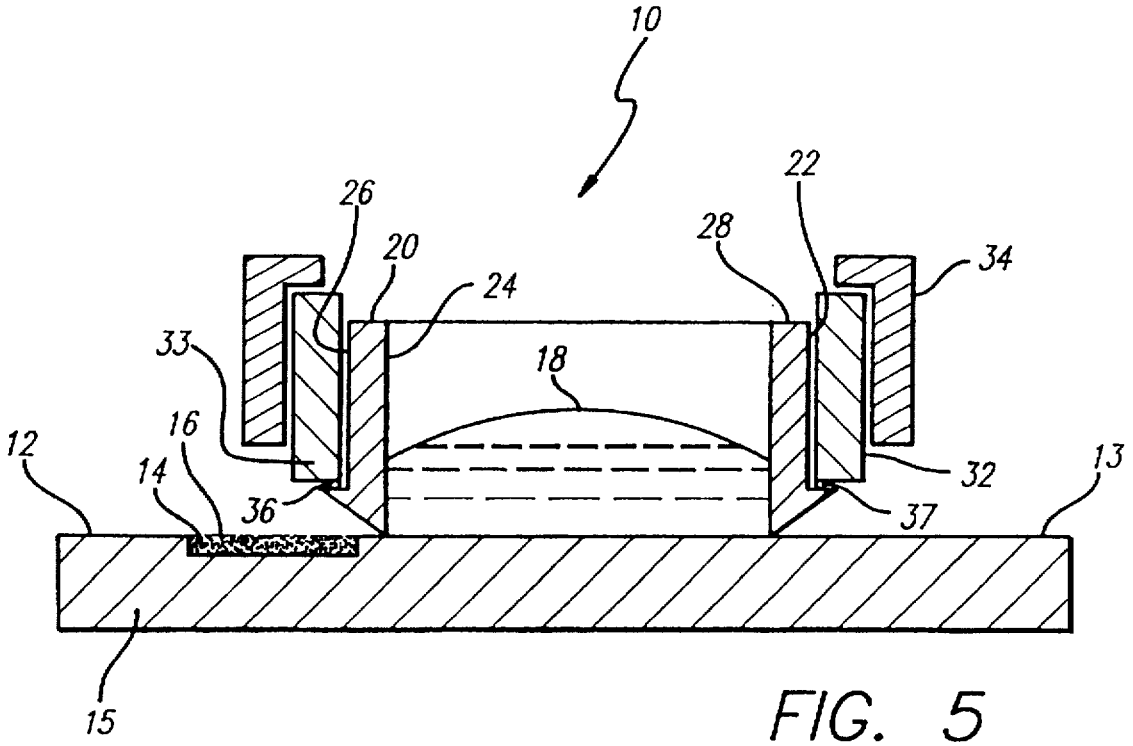
FIG. 5 is a cross-sectional view illustrating another embodiment of a device of the invention including a magnet extending over the top of an ink cup.

Magnet 32 is preferably a single continuous magnet which surrounds outer perimeter 26 of reservoir 20. The cross-sectional shape 33 of magnet 32 can vary. For example, as depicted in FIG. 1 it is a square; however, a circular or other cross-section can be used. The single continuous magnet 32 preferably is configured to provide an equal force at opposite points about wall 22, and preferably about outer perimeter 26. Most preferably all points about wall 22 and outer perimeter 26 will experience an equal downward force. In order to obtain such a result, magnet 32 is more preferably a ring shaped magnet surrounding outer perimeter 26 which is circular. However, a number of discrete magnets can be used to obtain a similar result. Magnet 32 can extend over the top surface 28 of reservoir 20 as depicted in FIG. 5.

Also, the force between different pairs of opposite points can vary. For example, the force at points on wall 22, if cylindrical, at 0 degrees and 180 degrees, e.g., two points opposite each other, can be X, while the force at opposite points at 90 degrees and 270 degrees can be Y. So long as forces X and Y are at least large enough to seal bottom surface 30 and surface 13 and the forces are in balance across reservoir 20, such a configuration is within the scope of the present invention. Any combination of magnets in any shape and configuration can be used so long as they provide this result. In a particular embodiment of the present invention, a Neodymium Iron Boron (NDFeB) magnet can be used. In another particular embodiment, the magnet used produces a force of about 0.28 kg/cm sealing force on outer perimeter 26 of reservoir 20.

Magnet 32 is preferably positioned at any location between top surface 28 and bottom surface 30 of wall 22. Magnet 32 more preferably does not extend above top surface 28 of wall 22. Magnet 32 is most preferably positioned closer to bottom surface 30 than to top surface 28.

In another embodiment of the present invention, magnet 32 can be disposed adjacent inner perimeter 24 of wall 22.

Collar 34 contacts reservoir 20 and is in force transferable contact with a means 35 for providing a force to device 10 (not shown) that can move device 10 along surface 13 of plate 12 in the direction of arrow A. Preferably collar 34 is disposed adjacent magnet 32. More preferably collar 34 exerts a force upon magnet which assists in retaining magnet 32 in contact with wall 22 of reservoir 20. Most preferably collar 34 is cylindrical.

As shown in FIG. 2, device 10 is movable from a first position (as in FIG. 1) in which reservoir 20 of device 10 was disposed over depression 14 in plate 12, to a second position in which reservoir 20 of device 10 is disposed over surface 13 of plate 12, and depression 14 filled with liquid 16 is exposed.

FIG. 3 is a top view illustrating device 10. Depression 14 can be seen to form a particular symbol.

Figure 4:
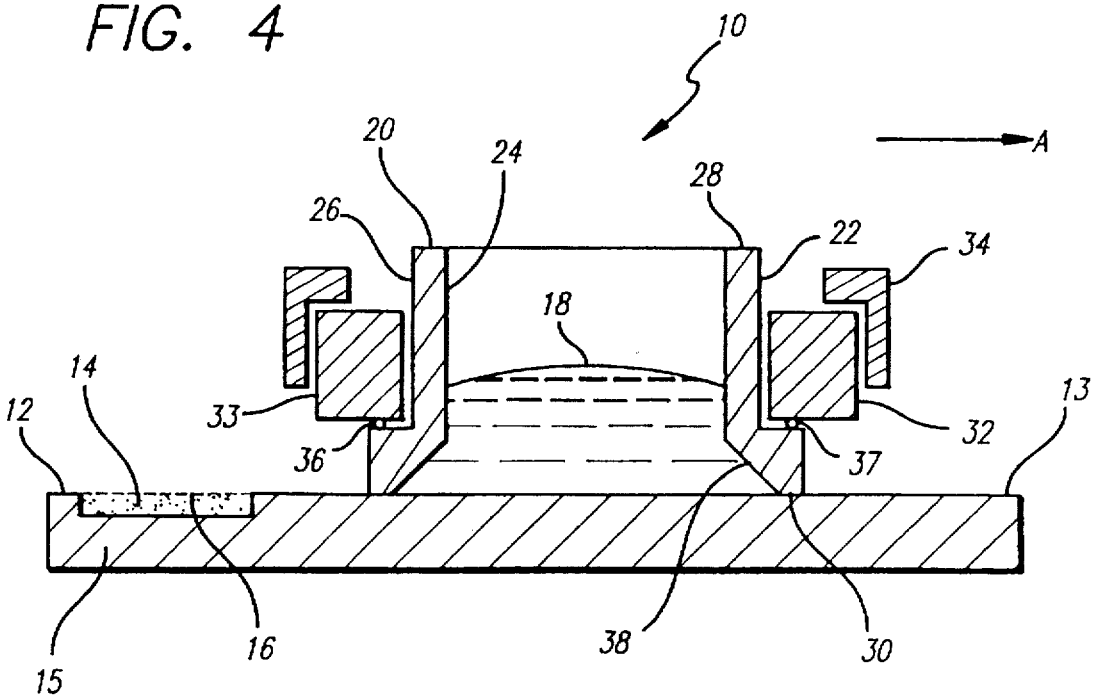
FIG. 4 is a cross-sectional view illustrating another embodiment of a device of the invention including a flared portion.

FIG. 4 is a cross-sectional view illustrating another embodiment of device of the present invention. Device 110 is similar to the device described with respect to FIG. 1, but includes a flared portion 38 disposed at a lower portion of inner perimeter 24. Flared portion 38 allows magnet 32 to engage lip 36 so that magnet 32 is preferably disposed over a larger portion of bottom surface 30, more preferably over the entire bottom surface 30. The magnetic force of magnet 32 thereby bears directly on a large portion of bottom surface 30. However, flared portion 38 minimizes the width of bottom surface 30 so that the frictional force between bottom surface 30 and surface 13 of plate 12 is not so high as to interfere with the movement of device 110 across surface 13.

Device 110 is suited for use in a transfer printing or pad printing apparatus. Such apparatus generally comprises a table 111 which supports plate 12, and means 35 for providing movement to reservoir 20 so that it moves across surface 13 of plate 12. The means 35 for providing movement to reservoir 20 can contact collar 34 which is in force transferable contact with the means 35 for providing movement to reservoir 20. In a transfer printing apparatus there is provided a pad 41 or other surface upon which a substrate to be printed, for example a paper sheet, can be placed. The pad 41 and the substrate thereon is brought into contact manually or mechanically with the surface of plate 12. The ink in depression 14 is thereby transferred to the substrate.

A pad printing apparatus functions similarly, except that the pad 41 itself is brought into contact with the surface of plate 12 and picks up ink from depression 14. The pad 41 is then brought into contact with an item to be printed, and transfers ink to that item. A pad printing apparatus is generally disclosed in U.S. Pat. No. 5,537,921, which is incorporated herein by reference.

A novel method of applying a liquid to a depression in a smooth flat plate that is responsive to a magnet is also provided. The method includes the step of contacting the plate with a reservoir for holding the liquid, as described herein. The bottom surface of the wall of the reservoir is adapted to closely contact the smooth flat surface of the plate. The method also includes the step of sealing the reservoir against the plate with at least one ring magnet adjacent the outer perimeter of the reservoir.

In a preferred embodiment the method includes the step of moving the reservoir across the smooth flat surface of the plate.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for applying a liquid to a depression in a plate, the plate being responsive to a magnet and having a smooth flat surface, the device comprising:

(a) a reservoir for holding the liquid, the reservoir including a wall having an outer perimeter, an inner perimeter, a top surface and a bottom surface, the bottom surface of the wall being adapted to closely contact the smooth flat surface of the plate; and (b) at least one ring magnet adjacent the outer perimeter of the wall of the reservoir.

2. The device of claim 1 wherein the outer perimeter is circular.

3. The device of claim 1 wherein the reservoir is a magnet.

4. The device of claim 1 wherein the bottom surface of the wall is a magnet.

5. The device of claim 1 further comprising a collar adjacent the magnet and the reservoir, wherein the collar is moveable such that the reservoir and the magnet can be moved across the smooth flat surface of the plate.

6. A device for applying a liquid to a depression in a plate, the plate being responsive to a magnet and having a smooth flat surface, the device comprising:

(a) a reservoir for holding the liquid, the reservoir including a wall having an outer perimeter, an inner perimeter, a top surface and a bottom surface, the bottom surface of the wall being adapted to closely contact the smooth flat surface of the plate; and (b) at least one magnet adjacent the outer perimeter of the wall of the reservoir, wherein the magnet does not extend above the top surface of the wall.

7. The device of claim 6 wherein the at least one magnet disposed between the top surface and the bottom surface of the wall of the reservoir is disposed closer to the bottom surface than to the top surface of the wall.

8. The device of claim 6 wherein the at least one magnet disposed between the top surface and the bottom surface of the wall of the reservoir comprises a first magnet disposed opposite a second magnet, said second magnet disposed below the bottom surface of the wall of the reservoir.

9. A device for applying a liquid to a depression in a plate, the plate being responsive to a magnet and having a smooth flat surface, the device comprising a reservoir for holding the liquid, the reservoir including a wall having an outer perimeter, the outer perimeter having a lip, the wall also having an inner perimeter, a top surface and a bottom surface, the bottom surface of the wall being adapted to closely contact the smooth flat surface of the plate and at least one ring magnet having an inner diameter and an outer diameter, the ring magnet being adjacent the outer perimeter of the wall of the reservoir.

10. The device of claim 9 wherein the ring magnet is adjacent the lip.

11. The device of claim 10 wherein the ring magnet is in contact with the lip.

12. The device of claim 9 wherein the inner diameter of the ring magnet is larger than the outer perimeter of the reservoir.

13. The device of claim 12 further comprising a collar adjacent the reservoir, wherein the collar is moveable such that the reservoir and the magnet can be moved across the smooth flat surface of the plate.

14. A printing apparatus comprising:

(a) a table, (b) a plate held by the table, the plate having a depression defined therein, the plate being responsive to a magnet and having a smooth flat surface, (c) a device for applying a liquid to the depression in the plate, the device comprising (i) a reservoir for holding the liquid, the reservoir including a wall having an outer perimeter, an inner perimeter, a top surface and a bottom surface, the bottom surface of the wall being adapted to closely contact the smooth flat surface of the plate, and (ii) at least one ring magnet adjacent the outer perimeter of the wall of the reservoir, and (d) means for moving the device (c) across the surface of the plate.

15. The printing apparatus of claim 14 further comprising a pad for contacting the surface of the plate.

16. The printing apparatus of claim 14 further comprising a collar adjacent the reservoir of the device for applying a liquid to the depression in the plate, the collar in force-transferable contact with the means for moving the device for applying a liquid to the depression in the plate.

17. The printing apparatus of claim 14 wherein the reservoir has a lip.

18. A method of applying a liquid to a depression in a plate that is responsive to a magnet, the plate having a smooth flat surface, the method comprising the steps of:

(a) providing a reservoir for holding the liquid, wherein the reservoir includes a wall having an outer perimeter, an inner perimeter, a top surface and a bottom surface, the bottom surface of the wall being adapted to closely contact the smooth flat surface of the plate, (b) providing at least one ring magnet adjacent the outer perimeter of the wall of the reservoir (c) contacting the plate with the reservoir for holding the liquid, and (d) sealing the reservoir against the plate with the at least one ring magnet.

19. The method of claim 18 further comprising the step of moving the reservoir across the smooth flat surface of the plate.

20. A printing system comprising (a) a plate having defined therein at least one depression said plate being responsive to a magnet and having a smooth flat surface, and (b) an ink cup for applying a liquid to the depression, the plate having a magnet therein attractive to the ink cup, the ink cup comprising (i) a reservoir for holding the liquid, the reservoir including a wall having an outer perimeter, an inner perimeter, a top surface and a bottom surface, the bottom surface of the wall being adapted to closely contact the smooth flat surface of the plate; and (ii) at least one ring magnet adjacent the outer perimeter of the wall of the reservoir wherein the plate includes a magnet thereon attractive to the ink cup.

21. The system of claim 20 where the magnet encircles the depression.

* * * * *